United States Patent [19]

DeBarbrie

[11] Patent Number: 4,457,202

[45] Date of Patent: Jul. 3, 1984

[54] DRUM SET APPARATUS

[76] Inventor: Steven J. DeBarbrie, 1555 Mesa Verde Dr., E #18A, Costa Mesa, Calif. 92626

[21] Appl. No.: 418,665

[22] Filed: Sep. 16, 1982

[51] Int. Cl.[3] ..... G10D 13/02

[52] U.S. Cl. ..... 84/411 R; 84/421

[58] Field of Search ..... 84/411–421

[56] References Cited

U.S. PATENT DOCUMENTS

| | | | |
|---|---|---|---|
| 4,111,094 | 9/1978 | Broser | 84/402 |
| 4,214,504 | 7/1980 | Rex | 84/411 R |
| 4,256,006 | 3/1981 | Widener | 84/411 R |

FOREIGN PATENT DOCUMENTS

| | | | |
|---|---|---|---|
| 44626 | 1/1982 | European Pat. Off. | 84/411 R |
| 1069999 | 11/1959 | Fed. Rep. of Germany | 84/419 |
| 52-23322 | 2/1977 | Japan | 84/411 R |
| 362297 | 7/1962 | Switzerland | 84/411 R |

*Primary Examiner*—Lawrence R. Franklin

*Attorney, Agent, or Firm*—Roger A. Marrs

[57] ABSTRACT

A percussion drum set is disclosed herein having an elongated semi-oval main shell with semi-squared ends enclosing a plurality of sound chambers or resonators in a side-by-side relationship. An auxiliary shell supports the main so that the drum height of the main shell is at one continuous level. A single continuous sound generator or head is adjustably carried across each shell covering the respective sound chambers. Alternately, a plurality of individual drums may be arranged in a row within each of the shells.

1 Claim, 11 Drawing Figures

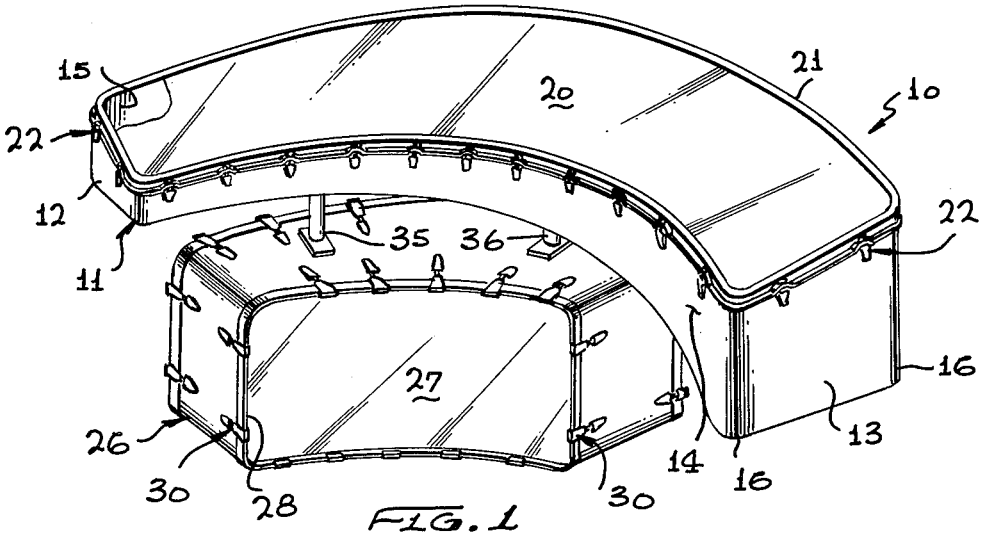
FIG. 1
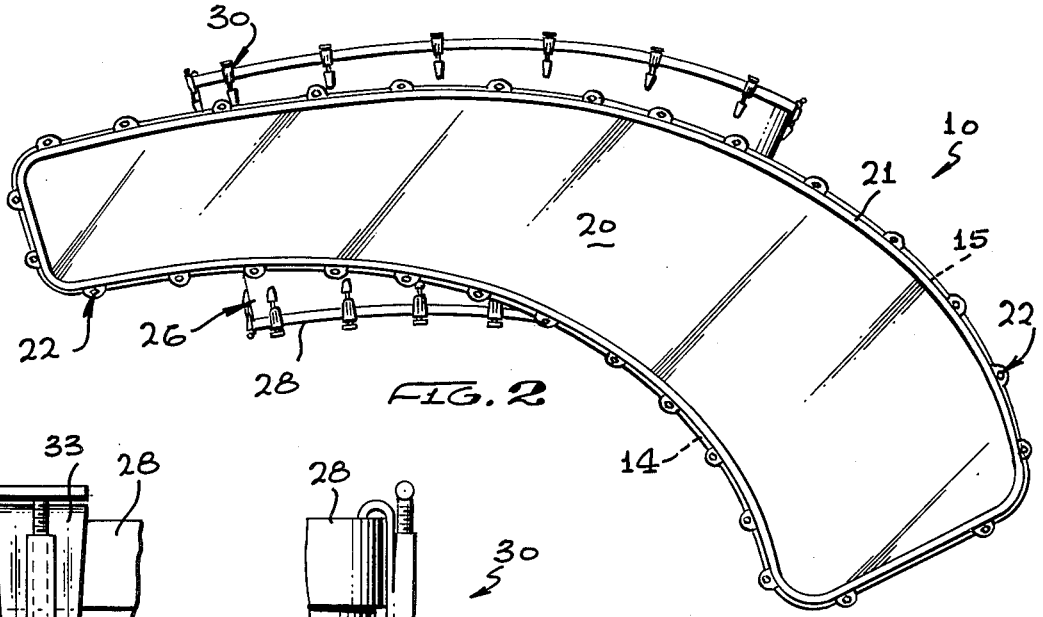
FIG. 2
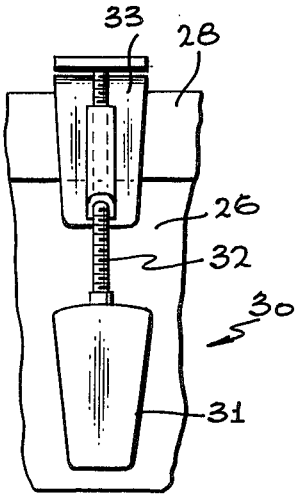
FIG. 3
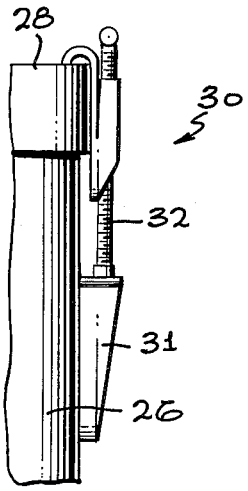
FIG. 4
FIG. 5
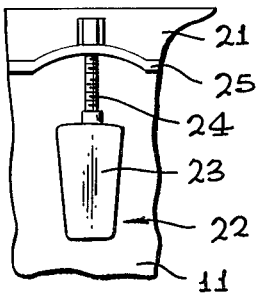
FIG. 6
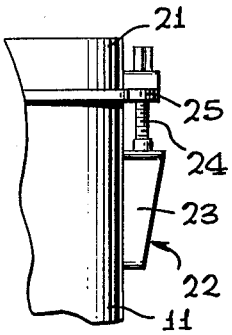

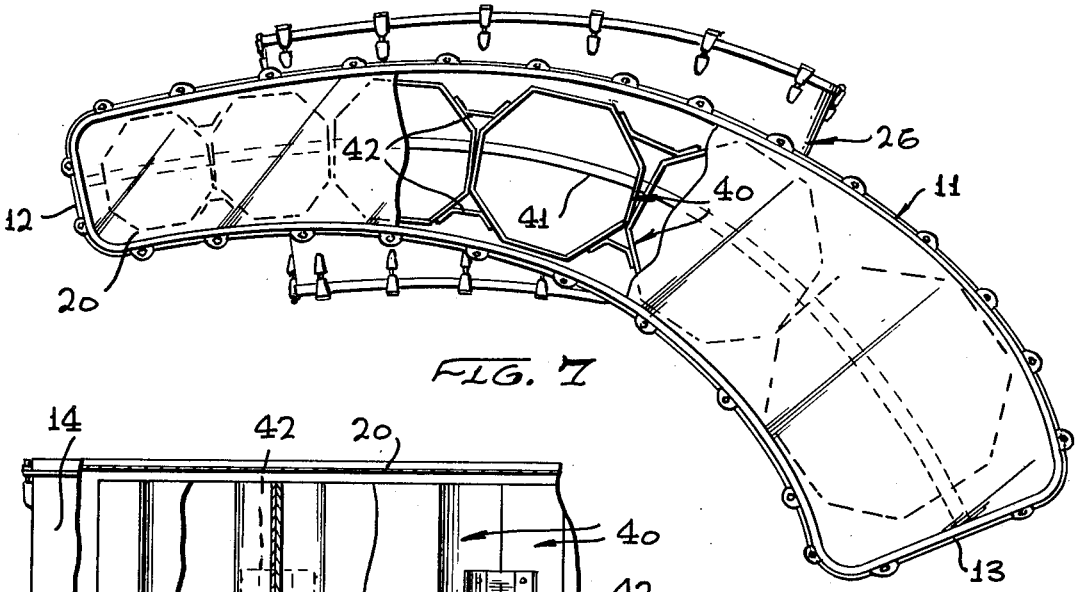
FIG. 7
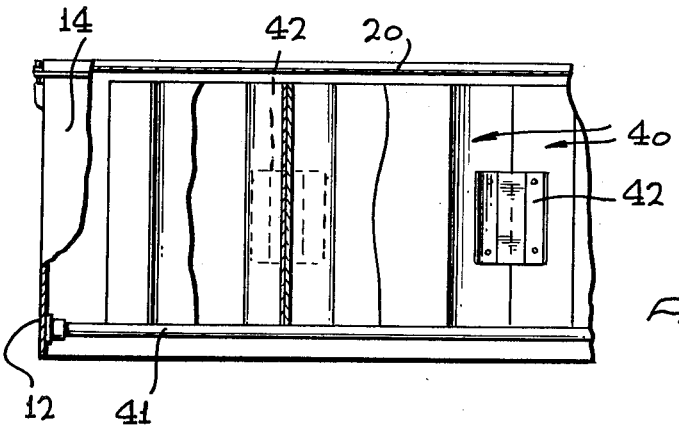
FIG. 8
FIG. 9
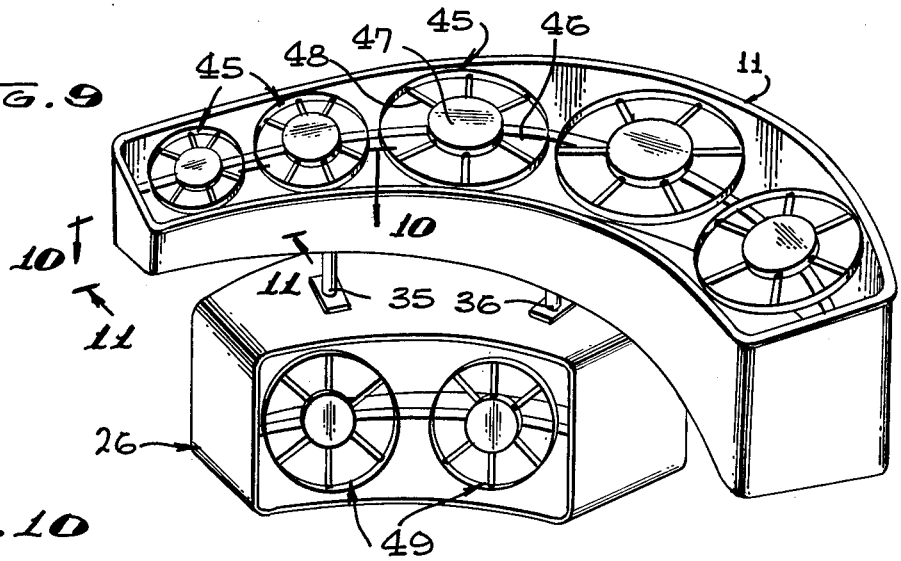
FIG. 10
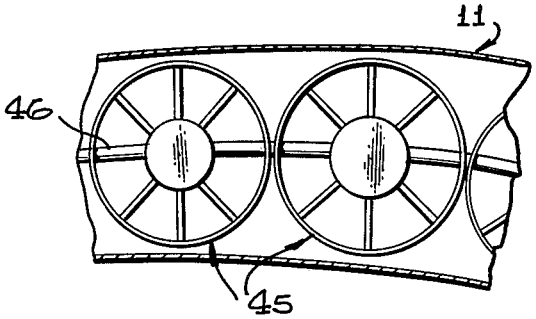
FIG. 11
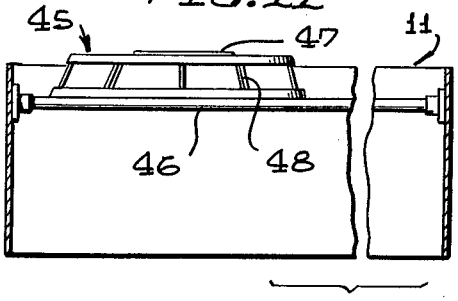

DRUM SET APPARATUS

BACKGROUND OF THE INVENTION

1. Field of the Invention

The present invention relates to the field of musical instruments and more particularly, to a novel drum set having a single shell enclosing a plurality of sound boxes, chambers or resonators.

2. Brief Description of the Prior Art

In the past, it has been the conventional practice to employ drum sets which combine a plurality of individual drums in a random or semi-random arrangement about the drummer so that the drummer may selectively strike individual drums in the set. In this arrangement, each drum is usually supported on its own stand or support and from a visual viewpoint, the drums are individually disposed and are not collectively covered or mounted in an organized manner. Furthermore, the height of the respective drum heads are different and not only obscure the drummer from view from some viewpoints, but requires that the drummer raise and lower his arms for striking the drum heads which are at different levels.

When it is desired to present a drum solo such as at the end of a set such as a "theatre piece" where both visual and music entertaining is desired, the appearance of the total drum set plays an important part and becomes a component of the concert format. For this type of solo, the audience is continually watching the performance of the drummer and his equipment so that the drummer's technique is emphasized and the drummer employs as many visual effects as possible. Therefore, the individual drums of the drum set sometimes obscure the visual portion of the drummer's performance from audience view and this detracts from the total performance.

Therefore, a long standing need has existed to provide a drum set comprising a plurality of drums which are enclosed and are of the same height or level so that the drummer is not obscured during his performance.

SUMMARY OF THE INVENTION

Accordingly, the above problems and difficulties are obviated by the present invention which provides a novel drum set comprising a plurality of sound chambers or resonators housed in an elongated semi-oval main shell and having a single continuous sound generator or head mounted on the shell over the sound chambers or resonators so that the drum height of the main shell is at one continuous level. Means are provided for supporting the main shell at the continuous level which may include an auxiliary or second shell which similarly incorporates a plurality of sound chambers or resonators and which includes a laterally disposed sound generator or head which is in communication with each of the respective sound chambers or resonators in the auxiliary shell.

Therefore, it is among the primary objects of the present invention to provide a novel drum set apparatus having a plurality of resonators or sound chambers arranged side by side in an arc wherein the sound generators or head of the sound chambers or resonators is at a constant height or level.

Another object of the present invention is to provide a novel drum set including an elongated, semi-oval main shell which integrally incorporates a plurality of sound chambers or resonators and which incorporates a single sound generator or head which is common to all of the sound chambers or resonators.

Still another object of the present invention is to provide a novel drum set which readily mounts a plurality of sound chambers or resonators in a manner which is visually pleasing, asthetic and compatible to a viewing audience so that the performer is not blocked or hidden from view.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood by reference to the following description, taken in connection with the accompanying drawings in which:

FIG. 1 is a rear perspective view of the novel drum set incorporating the present invention;

FIG. 2 is a top plan view of a drum set shown in FIG. 1;

FIG. 3 is an enlarged fragmentary view showing a typical claw hold down for retaining a drum sound generator or head in place;

FIG. 4 is a side elevational view of the claw hold down shown in FIG. 3;

FIG. 5 is a front elevational view of a hold down for a sound generator or head used in FIG. 1;

FIG. 6 is a side elevational view of the hold down shown in FIG. 5;

FIG. 7 is a view similar to the view of FIG. 2 having a portion of the sound generator or head broken away to expose the plurality of sound chambers or resonators installed on the shell;

FIG. 8 is a sectional view of the main shell shown in FIG. 7 taken in the direction of arrows 8—8 thereof;

FIG. 9 is a rear perspective view of another embodiment of the present invention illustrating the plurality of tom tom drums arranged in the shell incorporating the present invention;

FIG. 10 is a fragmentary plan view taken in the direction of arrows 10—10 in FIG. 9; and FIG. 11 is a transverse cross-sectional view of the tom tom drums shown in FIG. 10.

DESCRIPTION OF PREFERRED EMBODIMENT

Referring to FIG. 1, the novel drum set apparatus of the present invention is illustrated in the general direction of arrow 10 which includes an elongated, semi-oval shaped main shell 11 which is arcuate in plan view and terminates at its respective opposite ends in relatively flat panels 12 and 13 which are joined at their opposite ends by an arcuate inner panel 14 and an arcuate outer panel 15. The arcuate panels 14 and 15 are parallel in fixed spaced relationship with respect to each other and taper from their end connected with panel 13 in a tapering manner to the end connected to panel 12. Connection is made by circular corners such as corner 16 associated with adjacent opposing ends of panel 14 and end panel 13 respectively. However, it is to be understood that the top of the shell 11 is even in height above a supporting surface such as a floor or riser while the under surface or side of the shell 11 decreases in width as well as thickness from the end terminating with panel 13 towards the end terminating in panel 12.

The shell 11 contains a plurality of sound chambers or resonators, as will be described later, and includes a continuous sound generator or head 20 having its edge marginal region held to the perimeter or edge of the shell over the sound chambers or resonators and held in position by a rim 21 and a plurality of claw hold down fasteners such as fastener 22 shown more clearly in FIGS. 5 and 6. The fastener 22 includes a fixed portion 23 attached to the exterior surface of shell 11 while a bolt and nut fastener 24 projects through a flange 25 carried on the rim 21. In this manner, when the fasteners 22 are tightened, the drum head or generator 20 is maintained taut and rigid over the respective sound chambers underlying the head 20.

The head 20 is maintained so that its head is at one continuous level with respect to the performer or drummer by support means comprising an arcuate auxiliary drum shell 26 which is as of similar construction to the above described shell 11 with the exception that the auxiliary shell 26 is of constant width and height throughout its arcuate length. Also, the auxiliary drum 26 includes a plurality of sound chambers or resonators within its internal confines, to be described later, and the sound generator or head is represented by numeral 27. The drum head 27 is held taut and in place by means of a peripheral rim 28 that is held in position by a plurality of claw hold down fasteners such as fastener 30 shown more clearly in FIGS. 3 and 4. As illustrated, each of the fasteners 30 includes a portion 31 which is fixed to the shell 26 and includes a toggle bolt 32 which is threadably engaged with a claw or hook member 33 so that by turning the bolt 32, the hook or claw is tightened or loosened about the rim 28.

Referring further to FIG. 1, it can be seen that the main shell 11 is supported on the top of the auxiliary shell 26 by a pair of stanchions 35 and 36 which are attached at their respective ends to the top of shell 26 and the underside of shell 11.

Referring now in detail to FIG. 2, it can be seen that not only does the height of the shell 11 vary from its end terminating in panel 13 to its end terminating in panel 12 but that the width of the shell also diminishes in the same direction. By so varying the height and the width, a variety of sound chambers may be incorporated therein which are capable of producing a variety of sounds which are desired by the performer.

Referring now in detail to FIG. 7, it can be seen that a plurality of sound chambers or resonators are provided within the confines of the shell 11 as defined by the sidewalls or panels thereof. As illustrated, each of the plurality of sound chambers are octagon in plan view and a typical sound chamber is identified by numeral 40. The respective top and bottom of each of the sound chambers are open and, as shown in FIG. 8, the sound generator or head 20 is in close proximity to the open top of each of the respective sound chambers. The plurality of sound chambers or resonators are arranged in side-by-side relationship to form an elongated row between the end panels 12 and 13. The size of each of the sound chambers diminishes as the height and width of the shell diminishes from the end terminating in panel 13 to the end terminating in panel 12. In one form, the plurality of sound chambers are supported on a common bar 41 which extends between the opposite ends of the shell and follows the general arcuate curve thereof. Also, although the sound chambers may be mounted independent of each other, a joining bracket is illustrated by numeral 42 which may tie adjacent sound chambers together to form a unitary row.

Referring now in detail to FIG. 9, another embodiment of the present invention is illustrated wherein the drum set includes an identical shell arrangement 11 and 26 as previously described with the exception that the sound chambers 40 are eliminated and in their stead, a plurality of individual tom tom drums are disposed. A typical tom tom drum of conventional design is indicated by numeral 45 and is illustrated as being mounted on a bar 46 in a row following the arcuate pattern of the shell 11. In this instance, a drum head is not necessary since each of the individual drums, such as drum 45 includes its own sound generator or head. A typical sound generator is illustrated by numeral 47 which is held in the center of the drum 45 by radiating supports, such as support 48.

The shell 11 is supported in the same manner as previously described by the auxiliary shell or base shell 26 which also is occupied by a plurality of the individual tom tom drums such as tom tom drum 49.

In FIGS. 10 and 11, it can be seen that each of the individual tom tom drums is supported on the bar 46 and that the sound generator 47 is substantially level with the upper peripheral edge of the shell 11.

In view of the foregoing, it can be seen that the novel drum set apparatus of the present invention provides a continuous sound generator or head with an elongated, semi-oval shell having semi-square ends. The performer or drummer occupies the center of the arcuate configuration so that each of the respective sound generators is within his reach so that any drum can be struck at one continuous level. There are no separate pieces so that sound flow is simpler and faster than can be attained with conventional drum sets. Also, since the present invention is of a one piece or continuous design, the performer or drummer never has to be concerned about striking or hitting drum rims and destroying a well developed roll. Adjustment on the head 20 may be made by the appropriate tension lugs or fasteners to suit the desires of the performer. The plurality of sound chambers, such as chambers or resonators 40, form a series of eight-sided octagon or honeycomb constructions which are used to create distinctive pitches. As the membrane or head 20 is struck, directly over one of the sound generators, the sound waves are forced downward and captured by the honeycomb shell. Different pitches are created by the different dimensions of the honeycomb sound generator.

While particular embodiments of the present invention have been shown and described, it will be obvious to those skilled in the art that changes and modifications may be made without departing from this invention in its broader aspects and, therefore, the aim in the appended claim is to cover all such changes and modifications as fall within the true spirit and scope of this invention.

What is claimed is:

1. A drum set comprising:

an elongated, arcuate hollow, open-bottom shell having a greater depth at one end than at its opposite end;

a plurality of sound chambers surrounded by said shell whereby access to each of said chambers is available via the top of said shell;

a sound generator associated with each of said sound chambers and lying on the same horizontal plane with the shell top;

means supporting said shell on a supporting surface to maintain said sound generator on the horizontal plane of said shell top;

said supporting means is a second arcuate shell under said first shell;

said second arcuate shell having at least one sound chamber covered by a sound generator exposed at the back side of said drum set;

said sound chambers are open-ended and said sound generator is a sheet held taut across the top of said first shell in close proximity to the open-end of each of said sound chambers;

stanchions supporting first shell on said second shell in fixed spaced apart relationship; and said sound chambers are each of octagon shape in cross-section and attached to said shell in a row in side-by-side relationship.

* * * * *